US005836112A

United States Patent [19]

Lindale et al.

[11] Patent Number: 5,836,112

[45] **Date of Patent: *Nov. 17, 1998**

[54] PARTITION SYSTEM INCLUDING TRANSACTION TOP

[75] Inventors: Michelle L. Lindale, Muskegon, Mich.; Kurt P. Dammermann, San Francisco, Calif.

[73] Assignee: Steelcase Inc., Grand Rapids, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 853,889

[22] Filed: May 9, 1997

[51] Int. Cl.[6] ..... E04B 2/74; E04B 2/82

[52] U.S. Cl. ..... 52/36.4; 52/36.6; 52/239; 52/481.2; 52/489.2

[58] Field of Search ..... 52/36.4, 36.5, 52/36.6, 239, 481.2, 489.1, 489.2, 241; 108/137

[56] References Cited

U.S. PATENT DOCUMENTS

| | | | |
|---|---|---|---|
| 2,131,214 | 9/1938 | Bentz . | |
| 2,214,204 | 9/1940 | Pollard . | |
| 4,186,666 | 2/1980 | Honickman | 52/36.6 X |
| 4,596,098 | 6/1986 | Finkbeiner et al. . | |
| 4,600,173 | 7/1986 | Frascaroli et al. . | |
| 4,821,477 | 4/1989 | Rydqvist | 52/239 |
| 4,905,428 | 3/1990 | Sykes | 52/239 X |
| 4,914,873 | 4/1990 | Newhouse | 52/239 X |
| 4,932,177 | 6/1990 | Hinden . | |
| 4,986,505 | 1/1991 | Zabawski et al. . | |
| 5,038,539 | 8/1991 | Kelley et al. . | |
| 5,287,666 | 2/1994 | Frascaroli et al. | 52/239 |
| 5,642,593 | 7/1997 | Shieh | 52/239 |
| 5,711,115 | 1/1998 | Wirt | 52/36.4 X |
| 5,740,650 | 4/1998 | Seiber et al. | 52/239 X |
| 5,746,034 | 5/1998 | Luchetti et al. | 52/220.7 |
| 5,746,035 | 5/1998 | Seiber et al. | 52/238.1 |

FOREIGN PATENT DOCUMENTS

| | | | |
|---|---|---|---|
| 129841 | 11/1948 | Australia | 52/239 |

OTHER PUBLICATIONS

Exhibit A discloses a freestanding partition system installed in public location by Steelcase more than one year prior to filing the present application (5 pages).

Exhibit A discloses prior art assembly directions entitled *Series 9000®Panel Transaction Top*, published by Steelcase Inc. The directions disclose right and left hand braces for attaching a transaction top to vertical slots in a partition panel (3 pages).

*Primary Examiner*—Christopher Kent
*Assistant Examiner*—Laura A. Callo
*Attorney, Agent, or Firm*—Price, Heneveld, Cooper, DeWitt & Litton

[57] ABSTRACT

A partition system includes a partition having a top frame member with opposing sides. The sides include a row of component-supporting apertures that extend from end-to-end of the partitions. A transaction top is attachable to a top of the partition through use of brackets that are selectively engageable with the apertures, thus positioning the transaction top anywhere along a top of the partition, even in positions where the transaction top spans between in-line or perpendicularly connected partitions. The brackets engage the underside of the transaction top, and support the top above the partition. Unused slots under the transaction top remain accessible for use. Also, removable cover panels on the partitions are removable without disassembling the transaction top.

18 Claims, 5 Drawing Sheets

PARTITION SYSTEM INCLUDING TRANSACTION TOP

BACKGROUND OF THE INVENTION

The present invention relates to a partition system including a transaction top attachable in different locations to the top of a partition.

Partitions are often used in modern office settings to divide a building space into offices. In these offices, workspace is often at a premium. Transaction tops are sometimes attached to the free ends of some of the partitions to form team-type worksurfaces that can be used to conduct business between two or more people. A problem with these transaction top arrangements is that the location of the transaction tops is not adjustable. That is, the transaction top cannot be adjusted to an optimal position based on user preference, but instead the location is forced to a particular location at an end of a partition by the attachment bracketry and by the structure of its supporting partition. Further, the attachment bracketry is not quick and easy to connect or disconnect, such that more manual labor is required than desired for assembly/disassembly. Still further, often the attachment structure is unique to the partition system and transaction top, and is not part of a standard connecting structure to the frame, such that "extra" and customized additional pieces are required for assembly.

Accordingly, an apparatus solving the aforementioned problems is desired.

SUMMARY OF THE INVENTION

In one aspect, the present invention includes an apparatus for furnishing a building space to facilitate conducting of business or other transactions. The apparatus includes a partition having a frame, a transaction top for positioning above the frame, and brackets for attaching the transaction top to the frame. The frame includes sides defining a plurality of attachment locations configured to receive the brackets in at least two horizontally spaced locations. In a narrower aspect, the transaction top is positionable in any one of a plurality of discrete positions along the entire length of the partition.

In another aspect, an apparatus includes a partition having front and rear faces, and including a frame with a plurality of front and rear apertures accessible through the front and rear faces, respectively. A transaction top is provided including front and rear brackets constructed to engage selected ones of the front and rear apertures.

These and other features and advantages of the present invention will be further understood and appreciated by those skilled in the art by reference to the following specification, claims, and appended drawings.

DETAILED DESCRIPTION OF PREFERRED EMBODIMENT

For purposes of description herein, the terms "upper", "lower", "right", "left", "rear", "front", "vertical", "horizontal", and derivatives thereof shall relate to the invention as oriented relative to a standing or seated user of the transaction top. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figures 1, 2:
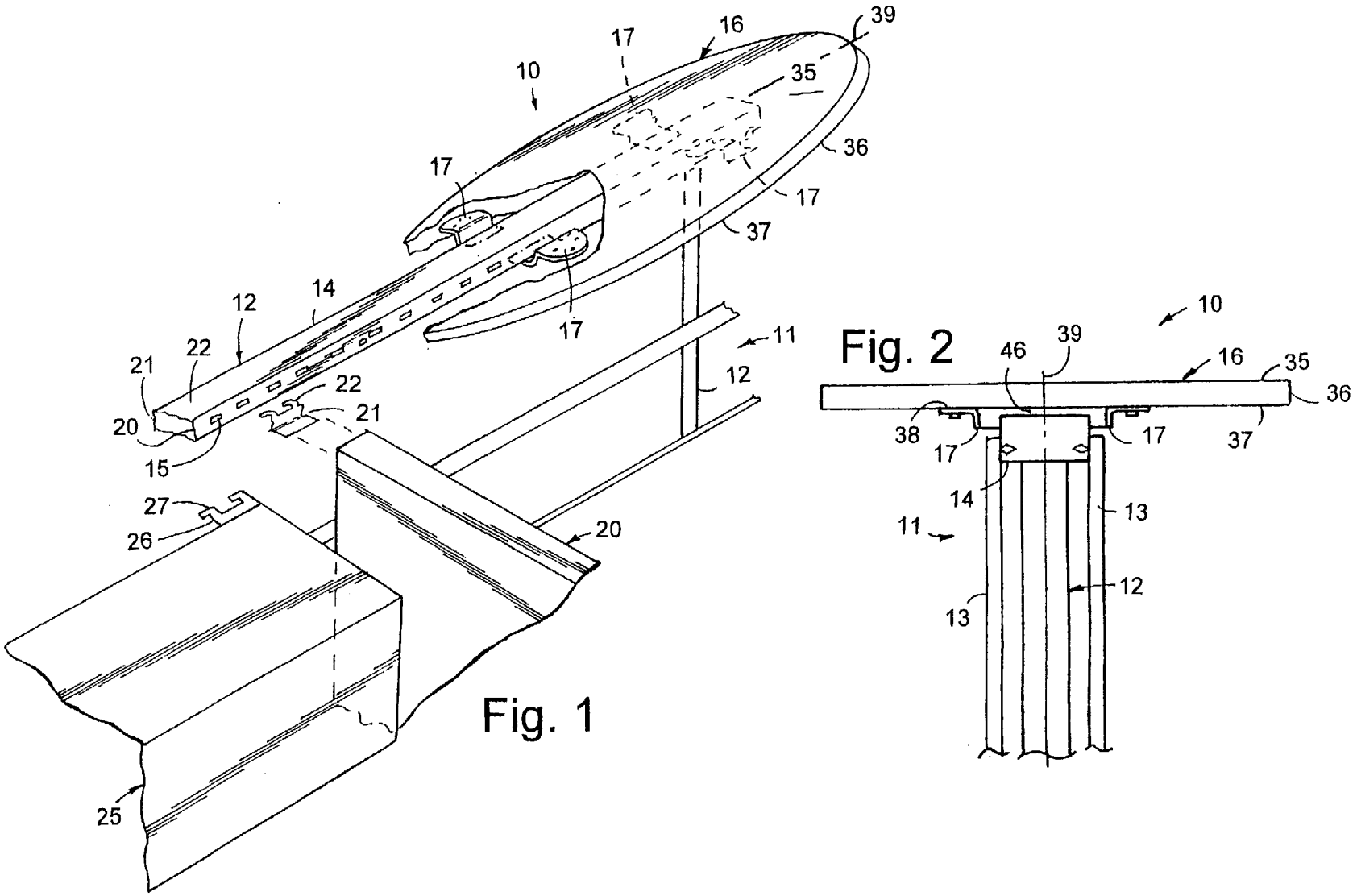
FIG. 1 is a perspective view of a partition system including a transaction top embodying the present invention, the transaction top being partially broken away to show the attachment bracketry.
FIG. 2 is an end view of the partition system and transaction top of FIG. 1.

An apparatus 10 (FIGS. 1 and 2) embodying the present invention includes a partition 11 having a frame 12 with front and rear sides, and removable spring-clip-attached cover panels 13 releasably attached to the frame 12 for covering the sides of the frame. The frame 12 includes a rectangularly-shaped horizontal top frame member 14 having horizontal rows of attachment slots 15 on its sides for supporting furniture components at a plurality of discrete locations extending along its full length. A transaction top or secondary worksurface 16 is attached to the horizontal top frame member 14 by brackets 17 configured to engage selected ones of slots 15. Advantageously, the transaction top 16 is attachable to the frame 12 in any one of the discrete attachment locations defined by the slots 15, such that the transaction top 16 can be positioned and secured anywhere along the frame member 14 as desired. Further, the transaction top 16 is easily and quickly repositionable by simply removing and later reattaching a few screws. Also, the transaction top 16 utilizes the attachment slots 15 provided on each frame 12 for supporting furniture components, and does not require separate special attachment structure on the frame, such that frame construction is simplified. Still further, unused attachment slots 15 remain open for use by other furniture components even at locations under the transaction top 16.

A detailed description of the present partition frame 12 is not necessary for an understanding for the present invention. Concurrently, it is contemplated that the present invention will work satisfactorily with many partition systems, and the present disclosure should not be interpreted as unnecessarily limiting. Nonetheless, it is noted that the partition system of the preferred embodiment is disclosed in detail in copending, coassigned applications Ser. No. 08/701,664, filed Aug. 22, 1996, entitled RECONFIGURABLE SYS- TEM FOR SUBDIVIDING BUILDING SPACE AND HAVING MINIMAL FOOTPRINT, and Ser. No. 08/767,814, filed Dec. 17, 1996, entitled PARTITION CONSTRUCTION, and which patent applications are incorporated in their entireties herein by reference.

The illustrated horizontal frame member 14 (FIG. 1) is rectangular and includes vertical side walls 20 and 21, and horizontal top wall 22. Each of the vertical side walls 20 and 21 include at least one row of horizontally spaced apertures 15 located on its opposing sides. As illustrated, the slots 15 are located in the middle of side walls 20 and 21, but it is noted that the slots can also be located at the top or bottom of the side walls, such as near the joinder of vertical side wall 20 with horizontal top wall 22, and near the joinder of vertical side wall 21 with horizontal top wall 22. The apertures 15 are elongated horizontally and are spaced apart at one-inch increments, although they can be any shape or spacing desired, including metric measurements. The material of horizontal top frame member 14 is sufficient in thickness and functional/strength properties to provide for structural attachment and support of furniture components attached thereto. A detailed description of such furniture components is found in related applications Ser. No. 08/701,664 and Ser. No. 08/767,814, the entire contents of which were previously incorporated by reference. For example, it is contemplated that furniture components such as a perpendicular partition 20 (FIG. 1) can be attached by brackets 21 having hooks 22 for selectively engaging slots 15, or a book binder 25 or shelf (not shown) having brackets 26 with hooks 27 for selectively engaging slots 15. Notably, even when transaction top 16 is attached to partition 11, any of furniture components 20 or 25 or others can be attached to partition 11 including locations under the transaction top 16. It is contemplated that the partition 11 can be located on any partition arrangement forming a building space dividing arrangement, including office and factory environments. It is also noted that the partition can be of a height selected to hold the transaction top 16 at a sitting height or at a standing height.

The illustrated top 16 (FIG. 1) is generally ovally shaped and is made of particle board, although various shapes, sizes, and materials can be used. Top 16 includes a smooth top surface 35 conducive for doing work and for conducting two-person or group activities. Top 16 further includes an elliptical or oval shaped marginal edge 36, and a bottom surface 37. A pattern of screw holes 38 are located on the bottom surface 37 generally symmetrically along the top's center line 39.

Brackets 17 (FIG. 3) are Z-shaped in cross section and include relatively flat panels 40, 41, and 42. Flat panel 40 is constructed to engage bottom surface 37 of top 16, and includes attachment holes 43 that align with holes 38 in the transaction top 16. Panel 42 extends generally parallel flat panel 40, and includes hooks 45 configured to engage selected slots 15 in the sides of the horizontal top frame member 14. Interlock tabs 45' are also provided on panel 42, and are offset upwardly so that they are not coplanar. Center panel 41 spaces panel 42 above panel 40 so that there is clearance 46 (FIG. 2) between the transaction top 16 and the top of the horizontal frame member 14. If desired, transaction top 16 can rest on the horizontal frame for support, although in the illustrated preferred embodiment, top 16 does not rest on the horizontal frame member 14 but instead is spaced thereabove. It is contemplated that a gasket, anti-scuff material, or a light shield can be placed under top 16 if desired.

When assembled, four or more brackets 17 connect transaction top 16 to the horizontal frame member 14, with two brackets 17 being on each side in opposition to each other. Since brackets 17 are positioned oppositely on the horizontal frame member 14, the hooks 45 face in opposing directions and securely fix transaction top 16 to the frame 11. Notably, the brackets 17 can be used on partitions having different thickness.

A number of different methods can be used to attach the transaction top 16 to the horizontal top frame member 14. In one method, two brackets 17 are preattached rigidly to the transaction top 16, and an additional two brackets 17 are provided separate from the transaction top 16. Transaction top 16 is then positioned on the frame 12 with hooks 45 of the fixed brackets 17 engaged with slots 15 one side of the frame 12. The brackets 17 can be manipulated so that their hooks 45 engage slots 15 on the frame 12. Thereafter, the screws in the preattached brackets 17 and in the separately provided brackets are tightened securely and fixedly to the bottom of the transaction top 16.

It is contemplated that the brackets could be attached to the tabletop by means other than screws. For example, the attachment could be fastenerless, such as by slidably attaching the plate 40 to the underside of the tabletop 16 with mechanically engaging protrusions and keyholes or the like.

To reposition the transaction top 16, the brackets 17 are loosened and/or removed, and the transaction top 16 is adjusted to a new position. Thereafter, the brackets 17 are reattached and retightened. Notably, the customer/user does not have to purchase a particular partition frame specially adapted to support a transaction top.

Figure 4:
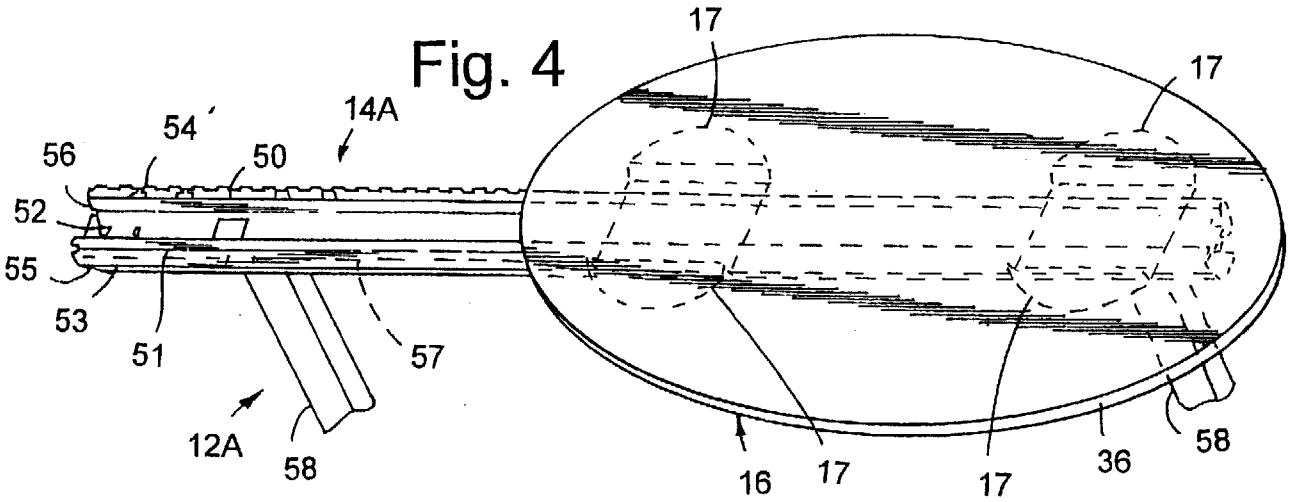
FIG. 4 is a perspective view of another partition system embodying the present invention, the system including a different partition than in FIG. 1, but a similar transaction top and similar brackets to FIG. 1.

FIG. 4 discloses a perspective view of the transaction top 16 attached to the top of frame 12A with brackets 17. The frame 12A includes a modified horizontal top frame member 14A. The top frame member 14A includes top walls 50 and 51 connected by a U-shaped center channel 52. Side walls 53 and 54 extend downwardly from the outer edges of top walls 50 and 51, respectively. Angled walls 55 and 56 extend downwardly and inwardly from outer vertical walls 53 and 54, respectively, and are interconnected by a bottom horizontal wall 57. Spaced apart uprights 58 are welded to bottom wall 57 to form a rigid frame. It is contemplated that the top frame member 14A of frame 12A will be about 3 inches wide, and will have a total width of about 4 inches when cover panels are attached thereto.

Figure 5:
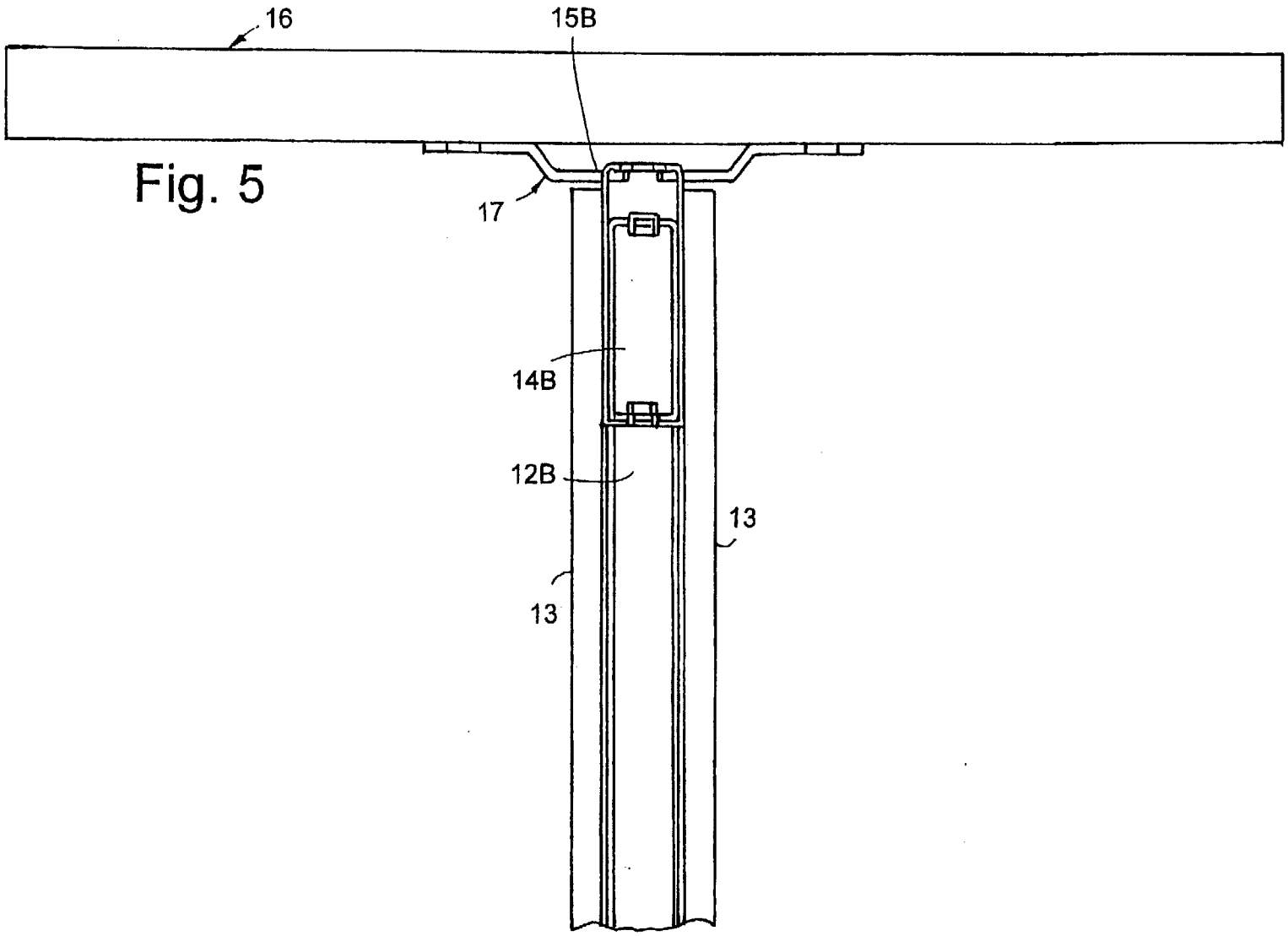
FIG. 5 is an end view of another partition system for supporting the transaction top and brackets of FIG. 1.

FIG. 5 discloses an edge view of a frame 12B including a top frame member 14B. Frame 14B is about 1 inch total thickness and when cover panels 13 are attached thereto becomes about 2 inch total thickness. The transaction top 16 is attached with brackets 17 to a horizontal row of slots 15B in the top frame member 12B, the slots being similar to slots 15 in frame 12.

Figure 7:
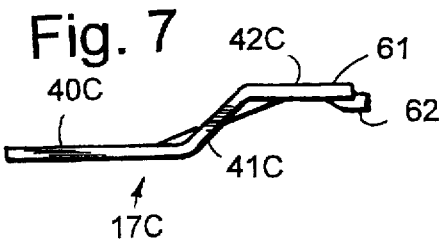
FIG. 7 is an edge view of the bracket shown in FIG. 6.
Figure 6:
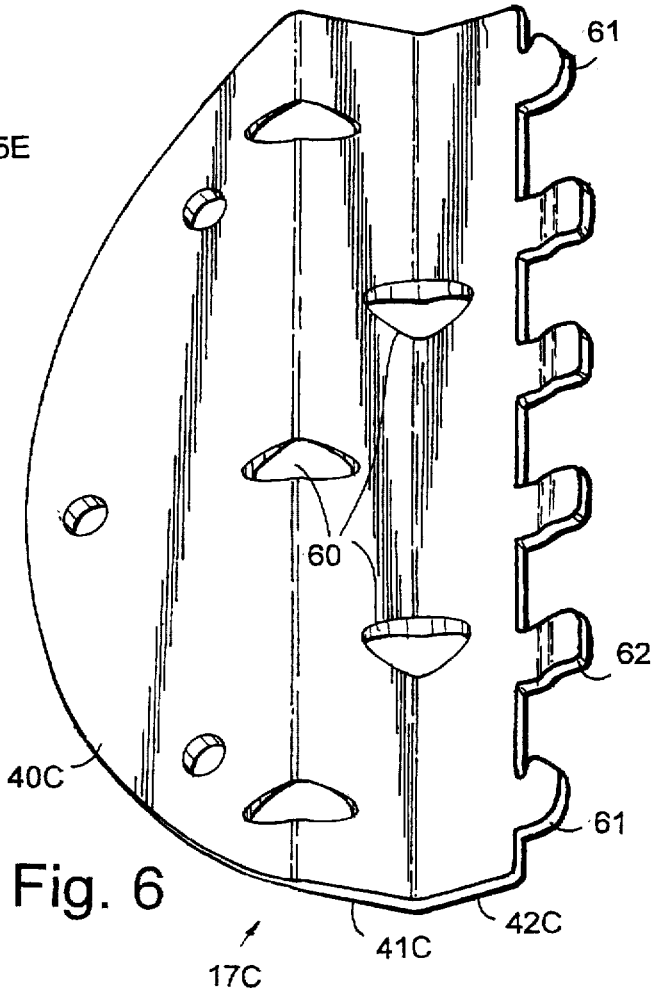
FIG. 6 is an enlarged view of the bracket shown in FIG. 5.

FIGS. 6 and 7 disclose a modified attachment bracket 17C. Bracket 17C is very similar to bracket 17, but includes additional stiffening gussets 60. Further, the center panel 41C extends at an oblique angle of about 30° to 45° to flat panels 40C and 42C. Also, the hooks include a coplanar hook 61 that is in-line and coplanar with panel 42C, and further include interlock hooks 62 that are offset from the plane of panel 42C.

Figure 8:
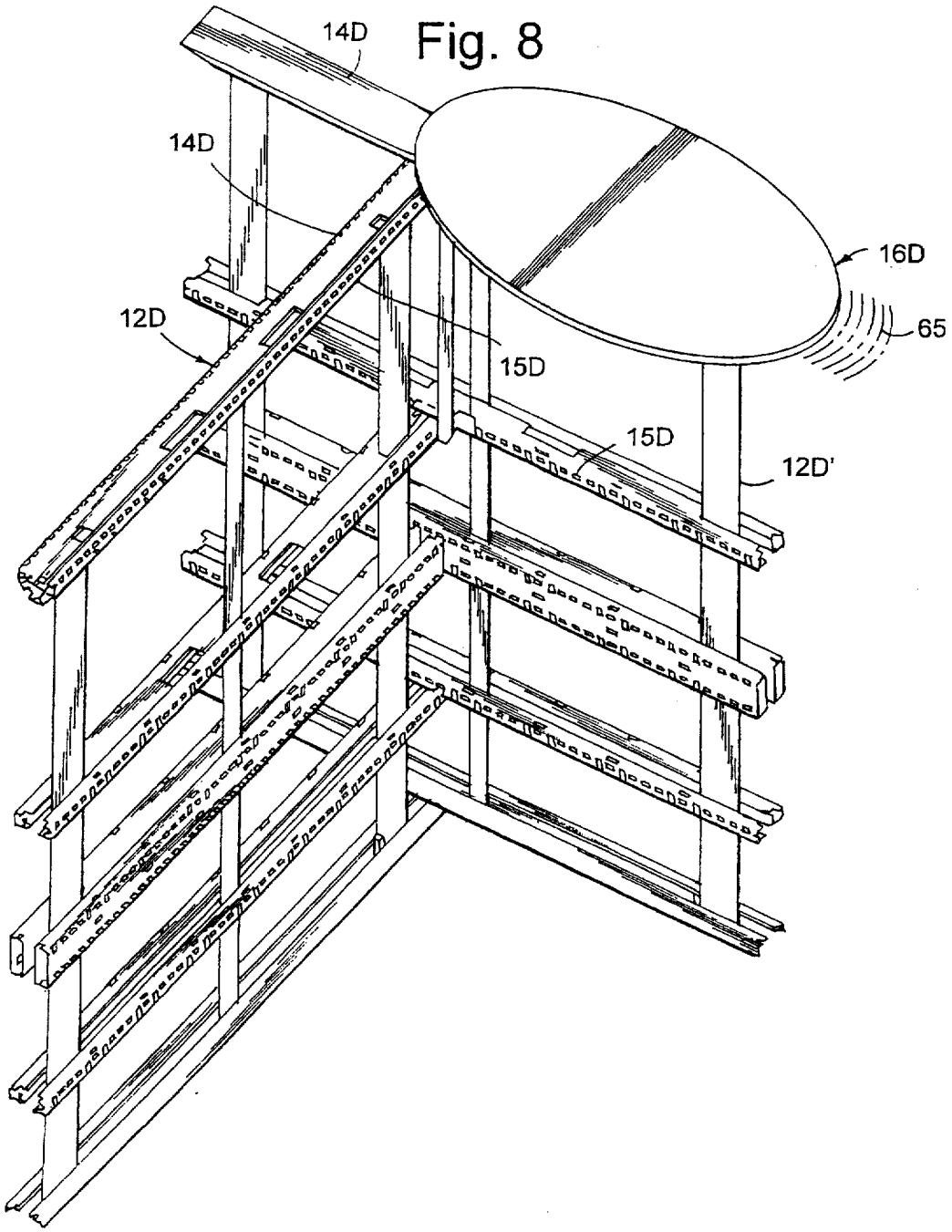
FIG. 8 is a perspective view of the partition system shown in FIG. 4, but including perpendicular partitions forming part of an office space.

FIG. 8 discloses a partition system wherein a first partition 12D of the type shown in FIG. 4 is connected off-module to a second partition 12D', at a location between the vertical side edges of the second partition 12D' to form a corner of an office arrangement. An egg-shaped transaction top 16D is attached to a top of the second partition 12D'. As illustrated by the multiple phantom lines 65, the transaction top 16D can be positioned in any one of several different discrete positions along the partition frame 12D'. It is further contemplated that the transaction top can be positioned anywhere along the first partition 12D as well, and can also be inverted 180° to better position the large end of the egg-shaped table top 16D.

Figure 3:
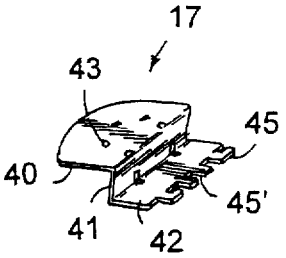
FIG. 3 is a perspective view of one of the attachment brackets shown in FIG. 1.
Figure 9:
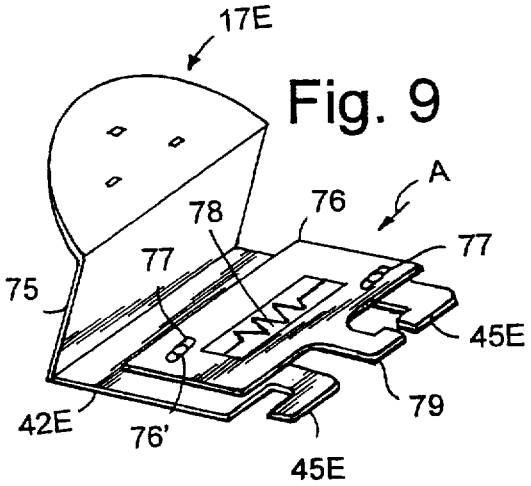
FIG. 9 is a perspective view of an alternative two-piece, spring-actuated bracket for supporting the transaction top.

FIG. 9 illustrates a modified attachment bracket 17E for connecting a transaction top 16 to any of the partition frames 12, 12A, 12B, and 12C. The bracket 17E (FIG. 9) includes a first bracket member 75 that is very similar to bracket 17 (FIG. 3). An additional movable interlock panel 76 is slidably positioned on panel 42E and secured thereto by rivets 76' for engaging slots 77 in the panel 76. A spring 78 is attached between the panel 76 and panel 42. Panel 76 includes an interlock hook 79 that opposes hooks 45E on panel 42E. The spring 78 biases the panel 76 to a normally engaged position. The interlock panel 76 can be biased in a direction A to an open/installation position wherein the bracket 17E can be extended into engagement with selected attachment slots of the top horizontal frame members 14, 14A, 14B, or 14D. When panel 76 is released, the panel moves to an engaged and secure position. Thus, the panel 76 can be preassembled to an underside of transaction top 16E.

Figure 10:
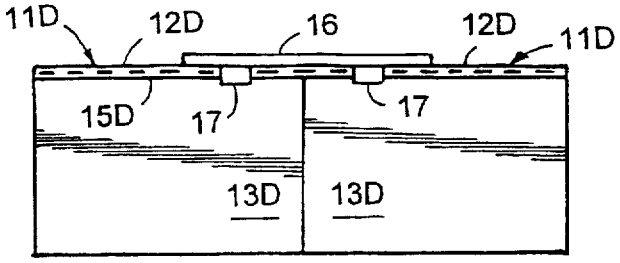
FIG. 10 is a side view of the partition system shown in FIG. 8, with a transaction top attached at a location spanning two partition frames.

FIG. 10 illustrates longitudinally aligned partitions 11D having in-line connected frames 12D with slots 15D therein, and covers 13D attached to the frames 12D in a manner leaving slots 15D accessible. Transaction top 16 is attached to frames 12D with two pairs of brackets 17. Notably, transaction top 16 spans between the two frames 12D, and is connected to each.

Accordingly, an apparatus is provided including a partition, a transaction top, and brackets for attaching the transaction top to the partition in a selected one of a plurality of locations along the top of the partition. In a preferred form, the locations are defined by discrete discontinuous slots, although it is contemplated that the present invention includes a frame member having a single elongated slot or rail along its top frame member.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An apparatus comprising:

a partition including a frame;

a transaction top positioned above the frame; and brackets attaching the transaction top to the frame, the frame including a top horizontal frame member with opposing apertured sides defining a plurality of attachment sites configured to receive the brackets in a plurality of horizontally spaced locations, the brackets being engaged with the frame in selected ones of the attachment sites.

2. The apparatus defined in claim 1 wherein the attachment sites are apertures.

3. The apparatus defined in claim 2 wherein the apertures include spaced apart and horizontally aligned slots.

4. The apparatus defined in claim 3 wherein the slots are spaced horizontally apart and form a row extending a full length of the top horizontal frame member.

5. The apparatus defined in claim 1 wherein the attachment sites include at least three horizontally spaced positions.

6. The apparatus defined in claim 5 wherein the apertured attachment sites are spaced apart horizontally on the frame.

7. The apparatus defined in claim 1 including cover panels removably attached to the frames.

8. The apparatus defined in claim 7 wherein the cover panels are configured to be removable from the partition from under the transaction top without disassembling the transaction top from the frame.

9. The apparatus defined in claim 1 wherein unused ones of the attachment sites are accessible under the transaction top for attachment of other furniture components.

10. The apparatus defined in claim 1 wherein the frame includes cover-supporting apertures separate from the attachment sites for attachment of cover panels thereto, and including cover panels adapted to releasably engage the cover-supporting apertures.

11. An apparatus comprising:

a partition including front and rear faces and including a frame having a top horizontal frame member with a plurality of front and rear apertures on the front and rear faces and accessible through the front and rear faces; and a transaction top including front and rear brackets constructed to engage selected ones of the front and rear apertures.

12. The apparatus defined in claim 11 wherein the front and rear apertures define a plurality of discrete attachment sites each spaced apart by a unitary uniform dimension.

13. The apparatus defined in claim 12 including a furniture component mounted to selected ones of the front apertures and located under the transaction top.

14. The apparatus defined in claim 11 wherein the apertures define a horizontal row of apertures spaced uniformly apart and extending a fall length of the frame.

15. The apparatus defined in claim 11 wherein the front and rear brackets include hooks for engaging the front and rear apertures on the frame.

16. The apparatus defined in claim 11 including cover panels removably attached to the frame under the transaction top.

17. The apparatus defined in claim 16 wherein the frame includes cover-supporting connectors for supporting the removable cover panels, the cover-supporting connectors being separate from the front and rear apertures.

18. A method including steps of:

providing a partition including a frame having a top horizontal frame member;

providing a transaction top for positioning above the frame;

providing brackets for attaching the transaction top to the frame;

selectively attaching the brackets to the frame at a desired location, the desired location being selected from a plurality of discrete positions defined along front and rear sides of the frame member; and attaching the transaction top to the brackets, thus securing the transaction top in a desired selected location on the frame.

* * * * *

US005836112C1

(12) REEXAMINATION CERTIFICATE (4355th)

United States Patent

Lindale et al.

(10) Number: US 5,836,112 C1

(45) Certificate Issued: May 15, 2001

(54) PARTITION SYSTEM INCLUDING TRANSACTION TOP

(75) Inventors: Michelle L. Lindale, Muskegon, MI (US); Kurt P. Dammermann, San Francisco, CA (US)

(73) Assignee: Steelcase Inc., Grand Rapids, MI (US)

( * ) Notice: This patent issued on a continued prosecution application filed under 37 CFR 1.53(d), and is subject to the twenty year patent term provisions of 35 U.S.C. 154(a)(2).

Reexamination Request:
No. 90/005,522, Sep. 29, 1999

Reexamination Certificate for:

| | |
|---|---|
| Patent No.: | **5,836,112** |
| Issued: | **Nov. 17, 1998** |
| Appl. No.: | **08/853,889** |
| Filed: | **May 9, 1997** |

(51) Int. Cl.[7] ..... E04B 2/74; E04B 2/82

(52) U.S. Cl. ..... 52/36.4; 52/36.6; 52/239; 52/481.2; 52/489.2

(56) References Cited

U.S. PATENT DOCUMENTS

| | | | |
|---|---|---|---|
| 3,425,568 | 2/1969 | Albright . | |
| 3,514,883 | 6/1970 | Albright . | |
| 4,619,486 | 10/1986 | Hannah et al. . | |
| 4,883,330 | 11/1989 | Armstrong et al. . | |
| 5,038,539 * | 8/1991 | Kelley et al. | 52/239 |

OTHER PUBLICATIONS

Exhibit A is a brochure entitled *Knoll—Hannah Desk System*, 18 pages, dated Oct. 1986.

Exhbit B is a brochure entitled *Knoll—Hannah Desk System*, 13 pages, undated but published in 1986.

Exhibit C is a publication entitled *Knoll—Hannah Desk System—Electrical Assembly Guide*, (12 pages), undated but published in 1986.

Exhibit D is a publication entitled *Knoll—Hannah Desk System—Assembly Guide*, 12 pages, undated but published in 1986.

* cited by examiner

*Primary Examiner*—Laura A. Callo

(57) ABSTRACT

A partition system includes a partition having a top frame member with opposing sides. The sides include a row of component-supporting apertures that extend from end-to-end of the partitions. A transaction top is attachable to a top of the partition through use of brackets that are selectively engageable with the apertures, thus positioning the transaction top anywhere along a top of the partition, even in positions where the transaction top spans between in-line or perpendicularly connected partitions. The brackets engage the underside of the transaction top, and support the top above the partition. Unused slots under the transaction top remain accessible for use. Also, removable cover panels on the partitions are removable without disassembling the transaction top.

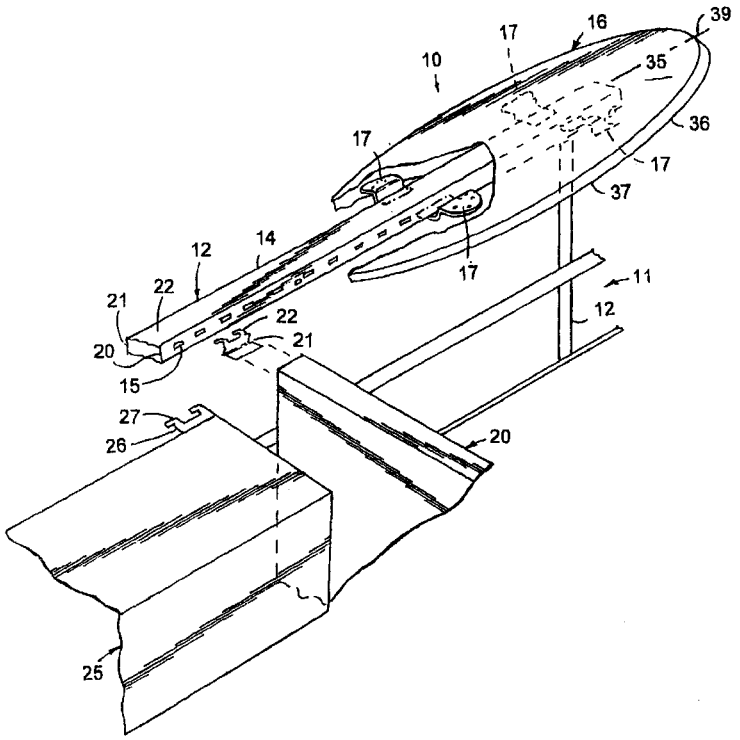

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 11 and 18 are determined to be patentable as amended.

Claims 2–10 and 12–17, dependent on an amended claim, are determined to be patentable.

1. An apparatus comprising:

a partition including a frame;

a transaction top positioned above the frame; and brackets attaching the transaction top to the frame, the frame including a top hozizontal frame member with opposing apertured sides defining a plurality of attachment sites configured to receive the brackets in a plurality of horizontally spaced locations, the brackets being engaged with the frame *and having a portion of the brackets being located* in selected ones of the attachment sites.

11. An apparatus comprising:

a partition including front and rear faces and including a frame having a top horizontal frame member with a plurality of front and rear apertures on the front and rear faces and accessible through the front and rear faces; and a transaction top including front and rear brackets constructed to engage selected ones of the front and rear apertures *by inserting a portion of the front and rear brackets into the front and rear apertures, respectively*.

18. A method including steps of:

providing a partition including a frame having a top horizontal frame member;

providing a transaction top for positioning above the frame;

providing brackets for attaching the transaction top to the frame;

selectively [attaching] *inserting a portion of* the brackets [to] *into* the frame at a desired location, the desired location being selected from a plurality of discrete positions defined along front and rear sides of the frame member; and attaching the transaction top to the brackets, thus securing the transaction top in a desired selected location on the frame.

* * * * *